United States Patent [19]

Stanley et al.

[11] 4,010,735

[45] Mar. 8, 1977

[54] WATER HEATER AIR INLET CONTROL

[75] Inventors: Robert F. Stanley, Glendale; Henry Jack Moore, Jr., Los Angeles, both of Calif.

[73] Assignee: Mor-Flo Industries, Inc., Cleveland, Ohio

[22] Filed: Jan. 21, 1976

[21] Appl. No.: 650,935

[52] U.S. Cl. ..... 126/350 R; 126/56; 98/13; 237/28

[51] Int. Cl.[2] ..... F24H 1/18

[58] Field of Search ..... 122/149; 126/56, 350; 98/2.14, 13; 237/28

[56] References Cited

UNITED STATES PATENTS

| | | | |
|---|---|---|---|
| 226 | 3/1859 | Spear | 98/3 |
| 406,120 | 7/1889 | Zimmerman | 126/56 |
| 477,811 | 6/1892 | Molloy | 126/56 |
| 3,028,843 | 4/1962 | Carlson et al. | 122/149 |

FOREIGN PATENTS OR APPLICATIONS

| | | | |
|---|---|---|---|
| 740,069 | 1/1933 | France | 98/13 |

*Primary Examiner*—John J. Camby
*Assistant Examiner*—Larry I. Schwartz
*Attorney, Agent, or Firm*—Ralph B. Pastoriza

[57] ABSTRACT

Inlet air for a water heater used in a trailer home or camper is provided through an air tube passing through the floor of the camper to the heater within the camper. The lower end of the air tube terminates short of the ground beneath the camper and includes a cup assembly arranged to rotate about the axis of the air tube. The cup assembly has a front opening and a rear rudder. Wind blowing under the trailer home or camper will orient the cup assembly so that the front opening faces the wind so that the inlet air is passed up through the air tube. Excess air can pass out a rear opening in the cup assembly.

5 Claims, 4 Drawing Figures

WATER HEATER AIR INLET CONTROL

This invention relates generally to hot water heaters and more particularly to a hot water heater with an improved air inlet control for use in trailer homes and campers or similar mobile residences.

BACKGROUND OF THE INVENTION

A persistent danger in the use of hot water heaters is possible asphyxiation by gas resulting from improper combustion as a result of down drafts. The design of various types of hot water heaters must therefore meet severe code requirements, particularly with respect to the inlet air opening.

A particularly dangerous situation exists in mobile homes such as trailer homes or campers wherein their location may be in an area of very high winds. It is not uncommon for such winds to reach 40 to 50 miles per hour and without proper design, suction conditions can develop when such winds blow past the air inlet. High velocity winds passing directly into the air inlet on the other hand could extinguish the pilot light or possibly the entire burner flame.

BRIEF DESCRIPTION OF THE PRESENT INVENTION

With the foregoing in mind, the present invention contemplates the provision of a hot water heater having a specially designed air inlet control means particularly useful for installation in trailer homes or campers wherein even under extremely high wind conditions, the risk of improper combustion because of down drafts or even possible extinguishment of the pilot light is virtually nil.

More particularly, in accord with the present invention, an elongated air tube is provided communicating at its upper end with the air inlet opening in the hot water heater and extending vertically downwardly. An air-cup assembly in turn is mounted to the lower end of the air tube for rotation about a vertical axis and includes a front opening facing horizontally and a rearwardly extending rudder.

With the foregoing arrangement, the air tube can extend downwardly through the floor of a trailer home or camper to expose the air-cup assembly to wind blowing under the trailer home or camper, the rudder orienting the air cup assembly so that the front opening faces the wind and air is scooped up into the air tube to the hot water heater.

Since the rudder structure assures that the air inlet opening will be facing the direction of the wind, venturi effects and the like which might cause back pressures resulting in dangerous down drafts of air flow are avoided. Moreover, in accord with further features of the invention, the lower inlet area of the water heater itself includes baffle discs which prevent strong air flows surges from directly acting on the heater means and associated pilot light.

BRIEF DESCRIPTION OF THE DRAWINGS

A better understanding of this invention will be had by referring to a preferred embodiment thereof as illustrated in the accompanying drawings in which.

DETAILED DESCRIPTION OF THE PREFERRED EMBODIMENT

Figure 1:
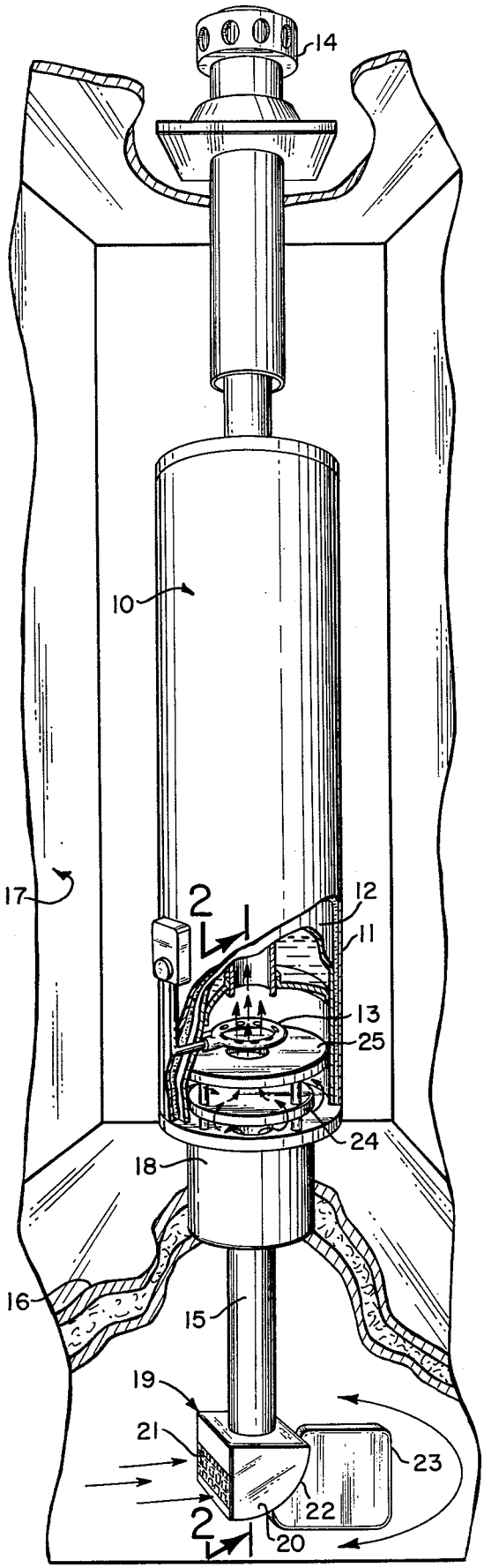
FIG. 1 is a broken away perspective view of a hot water heater incorporating the air inlet control means of this invention shown inside a portion of a trailer home or camper and with certain portions broken away to expose the interior.

Referring first to the central portion of FIG. 1, there is shown a hot water heater 10 including an insulated housing 11 incorporating a water tank 12. As shown in the broken away portion, a burner means 13 is provided under the tank 12, the tank itself having a central opening through which hot gases pass to exit through an upper gas outlet shown at 14 in the top of FIG. 1.

Referring now to the lower portion of FIG. 1, there is shown an elongated lower air tube 15 communicating with the lower interior of the housing 11 and extending vertically downwardly through the floor 16 of a trailer home or camper an interior portion of which is shown at 17. A surrounding cylinder 18 serves as an insulating medium for the air tube 15 from the floor 16, the hole through the floor being made of the same diameter as the air cylinder 18.

The lower end of the air tube 15 terminates short of the ground beneath the trailer home or camper. An air cup assembly designated generally by the numeral 19, in turn, is rotatably mounted to this lower end of the air tube for free rotation about the vertical axis of the air tube as indicated by the arrow.

Air cup assembly 19 includes an air scoop 20 defining a lower front opening 21 facing horizontally and a rear wall 22 curving upwardly as shown. A rudder 23 lying in a vertical plane is supported by and extends rearwardly from the air scoop 20.

Still referring to FIG. 1, the upper end of the air tube 15 within the outer air cylinder 18 terminates beneath a first baffle plate 24 in the form of a flat circular disc of diameter less than the interior diameter of the housing. This disc is supported in a horizontal position above the upper end of the air tube 15 and below the burner means 13 such that incoming air is deflected laterally by the underside of the disc to pass around the exterior perimeter of the disc.

Also provided is a second disc 25 of larger diameter than the first disc such that its periphery engages the inner wall of the housing 11. This second disc is positioned parallel to and above the first disc between the first disc and burner means and includes a central opening through which inlet air passes upwardly after passing about the exterior perimeter of the first disc.

Figure 2:
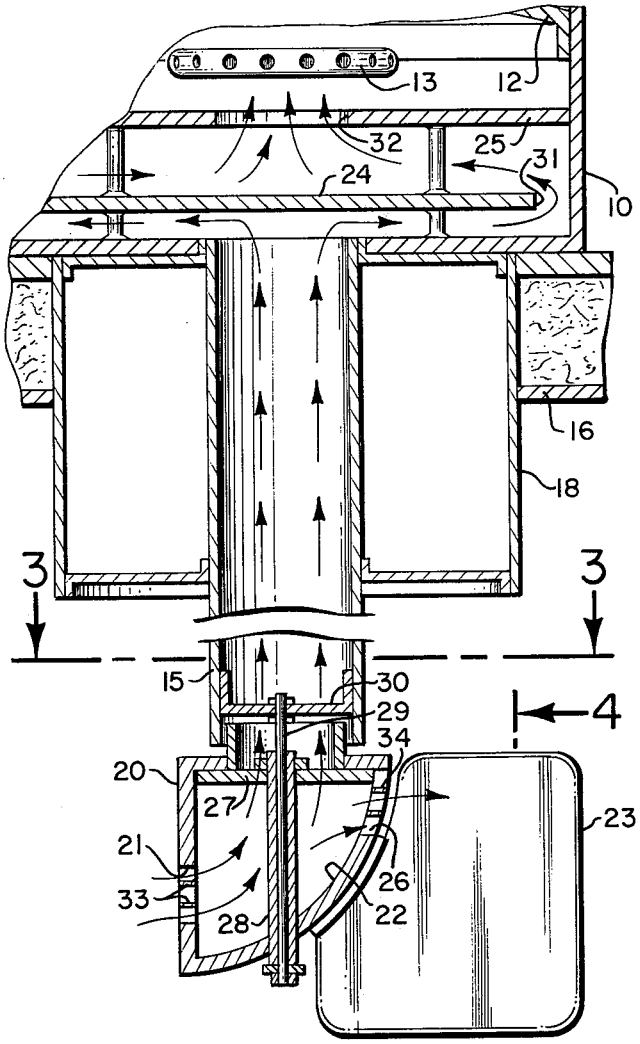
FIG. 2 is an enlarged fragmentary cross section taken in the direction of the arrows 2—2 of FIG. 1.

Referring now to FIG. 2, further details of the already described structure will be evident. In FIG. 2, components already described in FIG. 1 are designated by the same numerals. Referring first to the air scoop 20, it will be noted that the rear curved wall 22 includes an upper rear opening 26 facing rearwardly and vertically displaced from the front opening 21. In addition, the means for rotatably mounting the air cup assembly for rotation about a vertical axis coincident with the axis of the air tube 15 is shown. This structure includes a cross support bar 27 securing a journalling cylinder 28 at its upper end, the lower end of the cylinder 28 being held in the bottom portion of the curved wall 22. A stationary shaft 29 in turn extends from the journal 28 to a second cross support 30 secured to the lower end of the air tube 15. The arrangement is such that the air cup assembly can rotate about the shaft 29 freely through any number of turns. Further, the air cup arrangement can readily be disassembled by simply sliding the same from the shaft 29 by removing a lower end thrust bearing on the journal 28.

Referring to the upper ratio portion of FIG. 2, the air flow described in conjunction with the baffle plates 24 and 25 is indicated by the arrow. In FIG. 2, the spacing of the perimeter 31 of the first disc 24 from the wall of the housing 11 is clearly shown wherein the air is deflected laterally and must travel about this outer perimeter of the disc. The central opening in the second disc 25, in turn, is shown at 32 beneath the burner 13.

Referring once again to the lower cup assembly portion in FIG. 2, it will be noted that the lower front opening 21 and upper rear opening 26 are preferably provided with screens such as indicated at 33 and 34. These screens will prevent debris and the like from blowing into the air scoop portion of the cup assembly.

Figure 3:
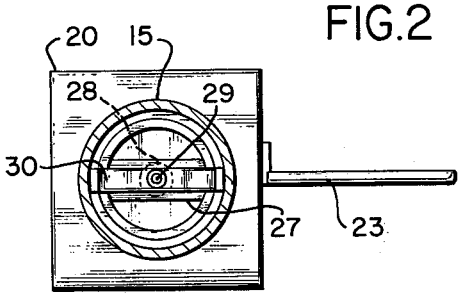
FIG. 3 is a plan cross section taken in the direction of the arrows 3—3 of FIG. 2; and, FIG. 4 is a fragmentary rear elevational view looking in the direction of the arrows 4—4 of FIG. 2.

The cross sectional plan view of FIG. 3 illustrates the cross bar supports 27 and 30 for the journal 28 and shaft 29 described in FIG. 2. It will be noted that these cross supports are fairly narrow to minimize obstruction of the air flow through the air inlet tube.

Figure 4:
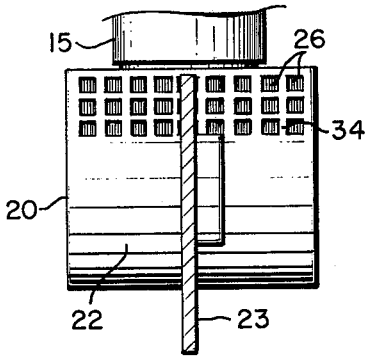

In the rear elevational view of FIG. 4, the screen 34 in the upper opening 26 is clearly visible.

OPERATION

In operation, the hot water heater 10 may be installed in a mobile home such as trailer home or camper by providing a suitable opening at a convenient location in the floor of the trailer home or camper to receive the outer air cylinder 18 which will provide an air insulation space annularly about the air inlet tube 15. The length of the air inlet tube 15 is such that its lower end will terminate short of the ground beneath the trailer home or camper so that the cup assembly 19 described in FIG. 1 is free to rotate about the vertical axis as described.

It will be evident that when a high gale or evan a small breeze is blowing beneath the trailer or camper, the rudder 23 will orient the cup assembly such that the front opening 21 faces the wind.

Referring to FIG. 2, the direction of incoming air flow is indicated by the arrow as described heretofore and it will be noted that this air is scopped up along the rear wall 22 and directed through the inlet air tube 15. In the event there is an excess of wind or air scooped into the cup assembly, this excess air will pass through the upper rear opening 34 as also indicated by the arrows.

When the air exits out the top of the air inlet tube 15, it will be deflected as described by the first baffle plate or disc 24 to pass around the perimeter of this disc and thence reverse direction to pass through the central opening 32 in the second disc 25 to the burner 13. Part of the air between the discs 24 and 25 may be supplied directly to mix with incoming gas for the burner 13 and the remaining air passing through the central opening 32 becoming heated and supplying oxygen for the burning flame from the heater 13 to thereby through heat exchange heat the water in the tank 12 while passing up the central opening shown in FIG. 1. The hot gases will exit from the upper outlet opening 14 as described in FIG. 1.

Because of the rudder arrangement 23 on the cup assembly the front opening 21 will always face towards the wind. This arrangement is important in that in the absence of a rotatable cup assembly, venturi effects could be caused by wind tending to flow across or in a direction opposite to the inlet direction of the inlet pipe which could cause reduced pressures and possible backflow resulting in undesirable down drafts.

On the other hand, any excess wind speed is diverted through the upper rear opening 26 from passing up the air inlet 15.

Finally, in cooperation with the foregoing, the arrangement of the first and second baffle discs as described causes the air to follow a circuitous path such that it is of not sufficient velocity by the time it reaches the burner to cause inadvertent extinguishment of the burner pilot light.

Tests of winds up to 50 miles per hour blowing directly into the unique air inlet control means of this invention have been made and in no instance has there been any inadvertent extinguishment of the heater pilot light by the incoming air.

From the foregoing description, it will thus be evident that the present invention has provided a greatly improved hot water heater together with an air inlet control means particularly useful in mobile residences such as trailer homes and campers.

What is claimed is:

1. An air inlet control means for a hot water heater having an air inlet opening in its lower end, including:

a. an air tube communicating at its upper end with said air inlet opening and extending vertically downwardly and, b. an air-cup assembly mounted to the lower end of said air tube for rotation about a vertical axis and including a front opening facing horizontally and a rearwardly extending rudder and having an air scoop portion defined by an upwardly curved rear wall opposite said front wall for guiding incoming air into the lower end of said air tube, said upwardly curved rear wall including an upper rear opening displaced in a vertical direction from said front opening and facing rearwardly for permitting an excess of air scooped in through said front opening to bypass said air tube so that a controlled air flow passes up said air tube, whereby said air tube can extend downwardly through the floor of a trailer home or camper to expose the air cup assembly to wind blowing under the trailer home or camper, said rudder orienting the air cup assembly so that the front opening faces the wind.

2. In combination with a hot water heater for trailer homes and campers including an insulated housing incorporating a tank of water, burning means in its lower end, and a gas outlet at its upper end, an air inlet control means for passing inlet air into the bottom of the housing for use in said burner means and for heating the water in said tank by heat exchange, said air inlet control means including:

a. an elongated lower air tube communicating with the lower interior of said housing and extending vertically downwardly through the floor of the trailer home or camper to terminate underneath the home or camper short of the ground; and, b. an air-cup assembly rotatably mounted to the end of said air tube for free rotation about the vertical axis of said air tube, said air cup assembly including an air acoop defining a lower front opening facing horizontally and a rear wall curving upwardly, the rear exterior of said air scoop supporting a rudder lying in a vertical plane and extending rearwardly of the air scoop whereby wind acting on said rudder will rotate the cup assembly until said front opening faces the wind so that inlet air blowing into said front opening is directed upwardly along said curved rear wall into said air tube, said air scoop including a rear opening in the upper portion of said rear wall adjacent to the lower end of said air tube such that an excess of air in high winds passes out said rear opening.

3. The subject matter of claim 2, in which said air inlet control means further includes in the lower interior of said housing a first baffle plate in the form of a flat circular disc of diameter less than the interior diameter of said housing, said disc being supported in an horizontal position above the upper end of said air tube and below said burner means such that incoming air is deflected laterally by the underside of said disc to pass around the exterior perimeter of the disc; and a second disc of larger diameter than said first disc such that its periphery engages the inner wall of said housing, said second disc being positioned parallel to and above said first disc between the first disc and burner means and including a central opening through which inlet air passes upwardly after passing about the exterior perimeter of said first disc whereby the risk of extinguishment of the burner pilot light by incoming air flow is substantially eliminated by the change in inlet air flow direction through said air scoop and about said discs.

4. The subject matter of claim 3, in which said lower front opening and upper rear opening in said air scoop includes screens to block debris from entering said air scoop.

5. The subject matter of claim 4, including an outer cylinder surrounding said air tube at the point it passes through the floor of said trailer home or camper to provide heat insulation between the air tube and the trailer home or camper.

* * * * *